United States Patent [19]

Wada

[11] Patent Number: 4,913,575

[45] Date of Patent: Apr. 3, 1990

[54] PRINTING MACHINE

[75] Inventor: Kenichi Wada, Osaka, Japan

[73] Assignee: Minolta Camera Kabushiki Kaisha, Osaka, Japan

[21] Appl. No.: 300,901

[22] Filed: Jan. 24, 1989

[30] Foreign Application Priority Data

Mar. 10, 1986 [JP] Japan ..... 61-53412

[51] Int. Cl.[4] ..... B41J 13/00

[52] U.S. Cl. ..... 400/638; 400/551/708

[58] Field of Search ..... 400/551, 636.1, 637.1, 400/708, 638, 645.3, 645.4, 645.5, 706, 707, 707.1, 707.5

[56] References Cited

U.S. PATENT DOCUMENTS

| | | | |
|---|---|---|---|
| 4,181,444 | 1/1980 | Heider | 400/551 X |
| 4,405,248 | 9/1983 | Wunderlich et al. | 400/551 X |
| 4,437,780 | 3/1984 | Weber et al. | 400/637.1 X |
| 4,439,051 | 3/1984 | Lanter | 400/551 X |
| 4,498,795 | 2/1985 | Tatara | 400/637.1 |
| 4,518,271 | 5/1985 | Hirata | 400/636.1 |
| 4,561,792 | 12/1985 | Behrens et al. | 400/708 X |
| 4,581,618 | 4/1986 | Watanabe et al. | 400/636.1 X |
| 4,602,883 | 7/1986 | Ozawa et al. | 400/637.1 |
| 4,603,987 | 8/1986 | Kuranishi et al. | 400/708 X |
| 4,641,830 | 2/1987 | Okuda et al. | 400/637.1 X |
| 4,644,372 | 2/1987 | Hirota | 400/708 X |
| 4,693,621 | 9/1987 | Kawaguchi | 400/637.1 X |

FOREIGN PATENT DOCUMENTS

| | | | |
|---|---|---|---|
| 126470 | 9/1980 | Japan | 400/637.1 |
| 164184 | 12/1980 | Japan | 400/707.5 |
| 228180 | 11/1985 | Japan | 400/707.5 |

*Primary Examiner*—Edgar S. Burr
*Assistant Examiner*—Ren Yan
*Attorney, Agent, or Firm*—Burns, Doane, Swecker & Mathis

[57] ABSTRACT

A printer with a printing paper feeding apparatus is disclosed.

The printer comprises a pressing device for pressing a printing sheet on the platen roller which is operable to an open position to allow the sheet to pass freely, a detection device for detecting a position of the sheet being fed along said platen roller by said sheet feeding device and an operation device for moving the pressing device from a said first position to a second position or vice versa according to the position of the sheet detected by the detection device.

3 Claims, 5 Drawing Sheets

PRINTING MACHINE

This application is a continuation of application Ser. No. 023,248, filed Mar. 9, 1987.

BACKGROUND OF THE INVENTION

1. Field of the Invention

The present invention relates to a printing machine such as a printer for a word-processor, type-writer or the like and, more particularly to a control system for press means for pressing a printing paper onto a platen roller.

2. Description of the Prior Art

In a printing machine such as a printer for a word-proccessor, typewriter or the like, there is provided a bail roller for pressing a printing paper onto a platen roller.

As shown in FIG. 1, the bail roller 5 is arranged at leading side of a printing position 1*a* when seen in a rotational direction of the platen roller 1 as indicated by an arrow X. Usually, it is arranged within a range of one inch in order to make sure the forwarding of a printing paper and to improve a quality of print. As is well known, the bail roller 5 is located at an open position apart from the platen roller 1, as is indicated by a dotted circle, when it is needed to print an area of a blank paper within one inch from the top edge 8*a* thereof. When an area thereof other than the area mentioned just above is to be printed, the bail roller 5 is closed to press the printing paper onto the platen roller 1 as indicated by a solid line. Namely, the bail roller 5 has to be operated manually from said open position to the press position thereof or vice versa.

In a conventional printer with such a bail roller mentioned above, a jamming is apt to be caused due to the bail roller since the top end of a printing paper is prevented to advance thereby in a case wherein an operator forgot to open it for printing said top area. Also, contrary to the above, when the bail roller is held at the open position, a quality of print is lowered since the printing paper is not held contact onto the platen roller tightly. Further, a possible trouble such as an inclination of the printing paper or a failure in forwarding the same is apt to be caused due to the same reason mentioned above.

In order to dissolve such troubles mentioned above, there has been proposed a printer wherein a blank paper is automatically set at an initial position by operating the bail roller to the open position with use of an operating lever therefor to rotate the platen roller by a predetermined angle. In this case, there may not be caused any trouble as far as the bail roller is so operated as to close to the press position thereof at the timing that the top edge of a printing paper has been advanced from the printing position in a predetermined length which is substantially equal to that of an arc of the platen roller measured from the printing position to the press position of the bail roller. since these operations are controlled sequentially, operational errors are reduced fairly.

However, in this printer mentioned above, it is impossible to print an area within one inch from the top edge of a printing paper, namely an area thereof defined between the bail roller 5 and the printing position 1*a*.

In order to dissolve this disadvantage mentioned above, there has been proposed a printer wherein the top edge 8*a* of a printing paper is forwarded to the printing position 1*a* at first when the bail lever is operated to open the bail roll to the open position and, then, the printing operation is started. When the top edge of the printing paper is forwarded by a predetermined length, the bail roller is automatically closed to press the top end portion of the printing paper onto the platen roller.

However, in this printer, if the platen roller is rotated in a reverse direction and the top edge has been drawn back from the position where the platen roller is contact with the bail roller, the printing paper might be jammed due to the rotation of the platen roller in a normal direction since the bail roller is kept at the closed position thereof.

SUMMARY OF THE INVENTION

One of objects of the present invention is to provide a printer having pressing means which is automatically opened or closed according to a position of the top edge of a printing paper.

Another object of the present invention is to provide a printer in which a printing paper can be printed on an area near to the top edge thereof without causing any jamming even when the platen roller is rotated in a reverse direction.

In order to accomplish these objects, according to the present invention, there is provided a printer with a printing paper feeding apparatus being characterized in comprising following means;

(a) platen roller being rotatable both in a normal direction and in a reversal direction;

(b) sheet feeding means for feeding a sheet along the surface of said platen roller not only in a forward direction but also in a backward direction accompanied by the rotation thereof;

(c) printing means for printing images on a printing sheet fed by said sheet feeding means, said printing means being arranged near the platen roller, (d) pressing means for pressing the sheet on said platen roller which is arranged at the leading side with respect to said printing means when seen in a normal rotational direction of said platen roller, said pressing means being displaceable between a first position at which it presses a portion of the printing sheet onto said platen roller and a second position at which it is located apart from said platen roller to make said sheet pass freely;

(e) detection means for detecting a position of the sheet being fed along said platen roller by said sheet feeding means; and (f) operation means for moving said pressing means from said first position to said second position or vice versa according to the position of the sheet detected by said detection means.

BRIEF DESCRIPTION OF THE DRAWINGS

These and other objects and other features of the present invention will become more apparent from the detailed description of the preferred embodiments of the present invention with reference to accompanied drawings wherein.

THE DESCRIPTION OF THE PREFERRED EMBODIMENT

Figure 1:
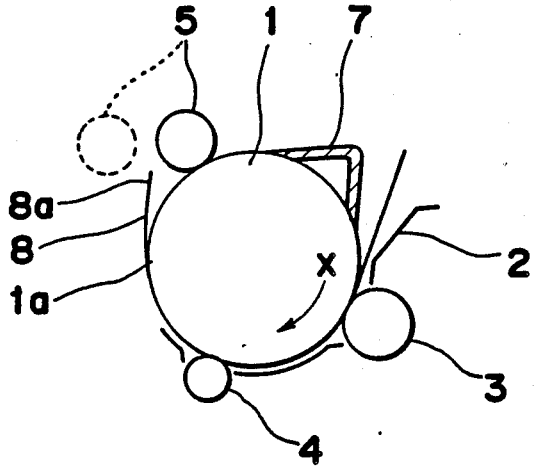
Fig. 1 PRIOR ART
FIG. 1 is a cross-sectional view of a platen roller portion of a conventional printer.
Figure 2:
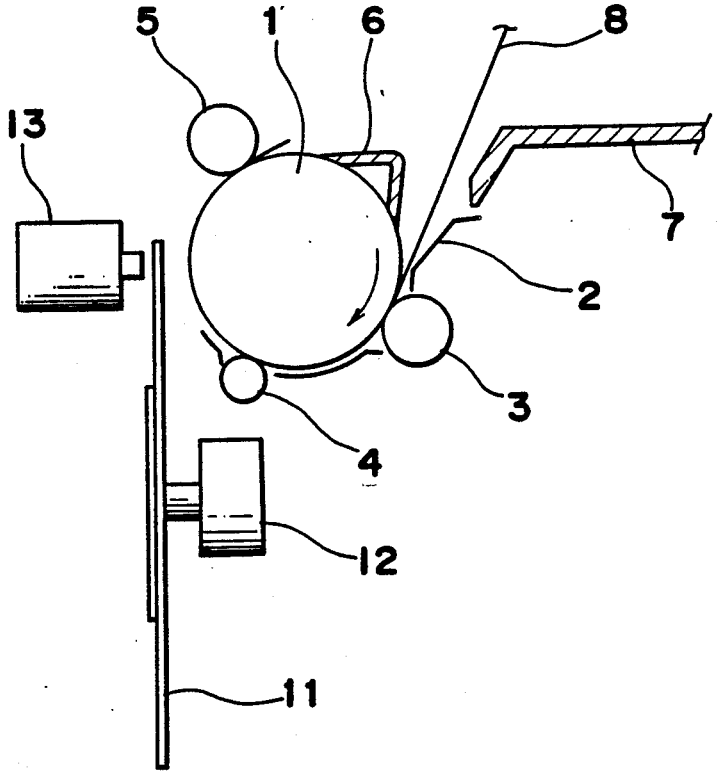
FIG. 2 is cross-sectional view of a printing head portion of a printer to which the present invention is applied.

FIG. 2 shows a cross-sectional view of a printing head portion of a printer according to the preferred embodiment of the present invention.

In the printing head portion, there is provided a platen roller 1 being driven to rotate both in a normal direction and in a reversal direction. A blank sheet 8 is inserted between the platen roller 1 and a guide 2, is pressed onto the platen roller 1 by pressure rollers 3 and 4 and a bail roller 5 and is advanced to print a new line by a rotation of a predetermined angle of the platen roller driven by a platen feed motor after a completion of one line printing. A paper guide 6 formed by a right angle channel member is provided for guiding the top end portion of a printed sheet not to be wound around the platen roller 1 again.

Upon printing, a daisy wheel 11 having a set of printing types therearound is rotated by a wheel motor 12 so as to locate a printing type to be printed at the printing position and, then, the printing type is tapped by a hammer 13 onto the platen roller 1 inbetween a ribbon (not shown) and a printing sheet.

Figure 3:
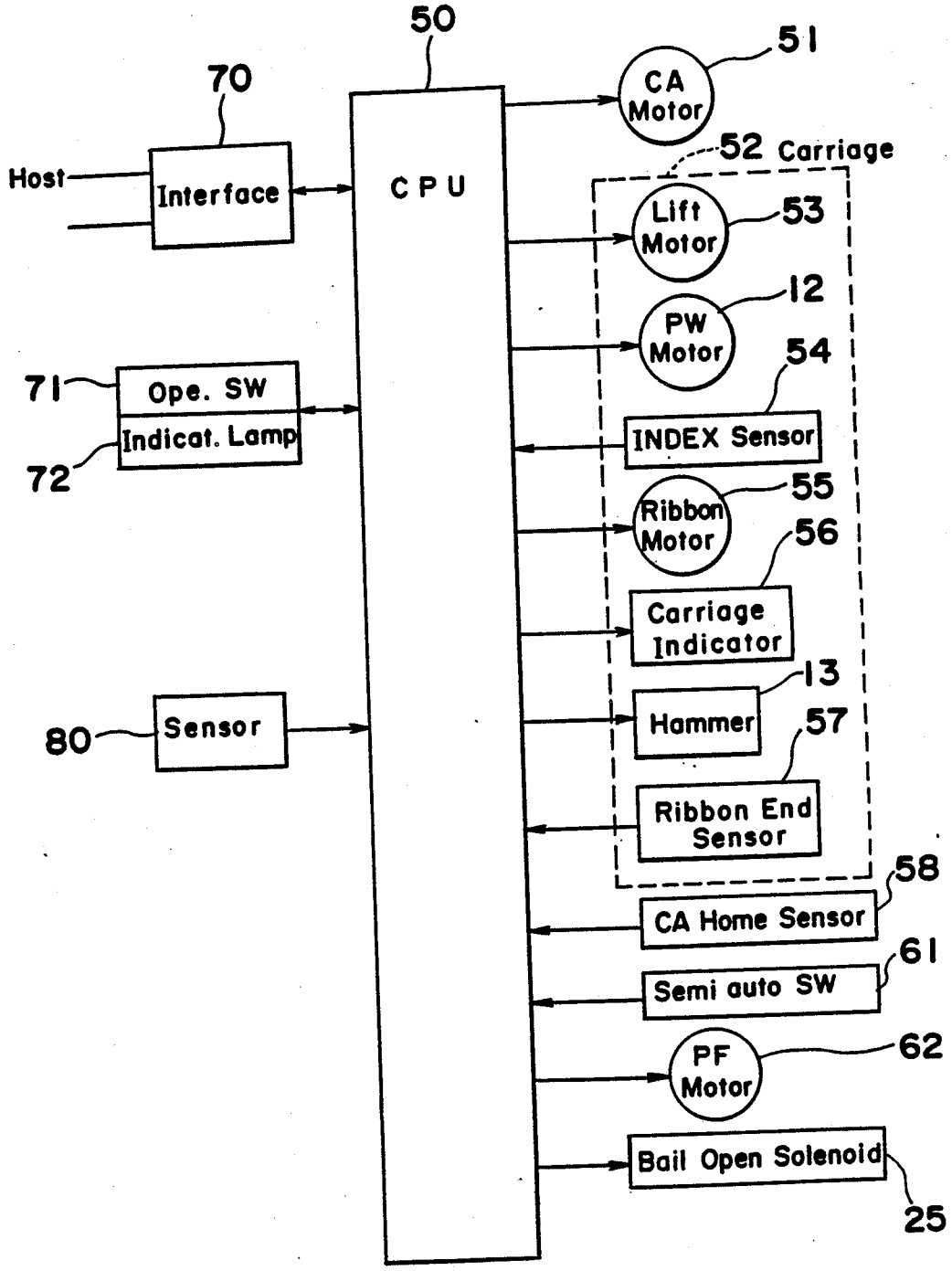
FIG. 3 is a block-diagram of a control circuit for controlling a bail roller according to the present invention.

FIG. 3 shows a block diagram of a control circuit for controlling the printer and the automatic paper feeding apparatus.

A micro-computer 50 is provided for controlling many parts connected thereto based upon information data input thereinto. A carriage motor 51 is controlled by a driver circuit (not shown) formed in the microcomputer 50 in order to drive a carriage 52 for moving the printing head parallel to the axial direction of the platen roller 1 upon printing. On the carriage 52, there are provided a lift motor 53 for shifting a ribbon cartridge (not shown) upwardly or downwardly, the daisy wheel 11, the wheel motor 12 for rotating the daisy wheel 11, a so-called index sensor 54 for detecting a rotational position thereof, a ribbon motor 55 for forwarding the ink-ribbon, a lamp 56 for indicating a position of the carriage 52, the hammer 13 and a photo-sensor 57 for detecting a bottom end of the ink-ribbon. In order to detect whether the carriage 52 is located at a home position to which it is returned to start printing, there is provided a carriage home sensor 58 comprised of a micro-switch. Further, there are provided a platen-feed motor 62 for driving the platen roller 1 and a solenoid means 63 for operating the bail roller 5 from an open position for making the paper free to a close position for pressing said paper onto the platen roller 1 or vice versa. A semi-auto switch 61 is provided as a switch for driving the platen roller 1 in order to set a blank paper inserted manually at the printing position when it is operated by pulling a bail lever to said open position. Further, a sensor 80 being arranged close to the printing position is provided for detecting the top end of a printing paper when it is forwarded to the printing position. Moreover, there is provided an operation switch 71 for switching the connection between the printer and a host computer from "OFF-Line" to "ON-Line" or vice versa. An indicating lamp 72 is provided for indicating whether the printer is ON-lined to the host computer or not.

The microcomputer 50 is connected to the host computer via an interface 70 in order to access data therefrom.

Figure 4:
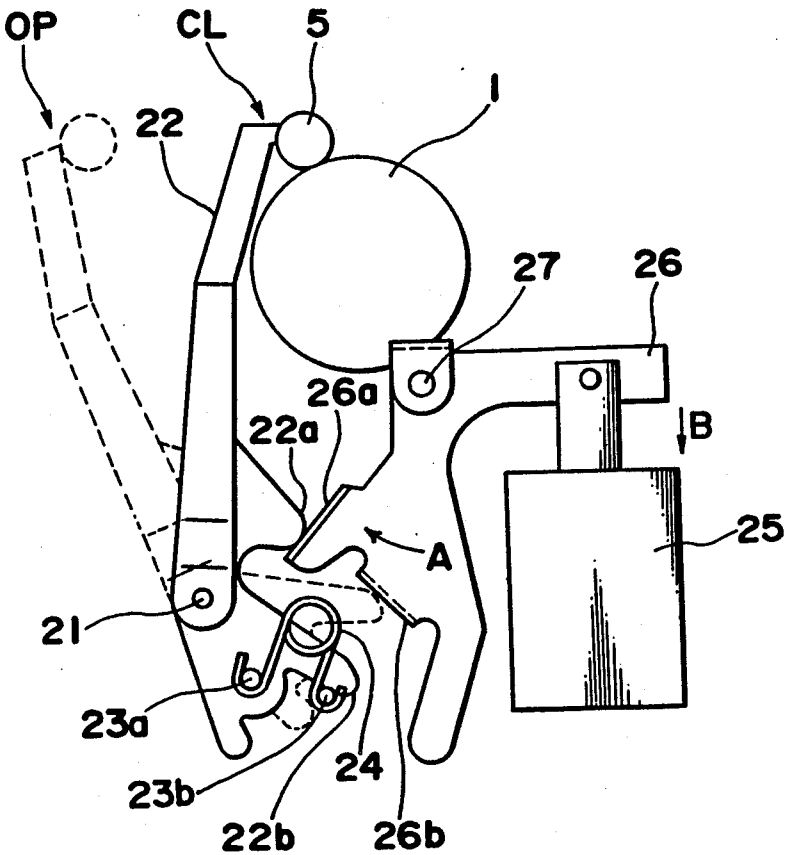
FIG. 4 is a side elevational view for showing an operation mechanism for operating the bail roller according to the present invention.

FIG. 4 shows an operational mechanism for the bail roller 5.

The bail roller 5 is supported rotatably around the axis thereof on a free end of an arm member 22 which is hinged swingably around an axis 21 fixed to the main body of the printer. The arm member 22 has two projection portions **22*a* and 22*b* which are formed so as to project toward a same side with respect to the lengthwise direction thereof, respectively. In order to bias said arm member, there is provided a snap acting spring 24 one end of which is engaged to a pin 23*a* erected on the other end portion of the arm member 21. The other end of the snap acting spring 24 is engaged to a pin 23*b* fixed to the main body of the printer. The bail roller 5 is firmly held by the snap acting spring 24** at an open position OP as indicated by a dotted line or at a close position CL as indicated by a solid line.

This arm member 22 and the bail roller 5 are operated, via a lever means 26, by a solenoid means 25 which is connected to one end of the lever means 26.

The lever means 26 is formed of a right angle member and is hinged swingably around an axis 27 fixed to the main body. This lever means 26 has two contacting portions **26*a* and 26*b* corresponding to the projection portions 22*a* and 22*b* of the arm member 22**, respectively.

Figure 5:
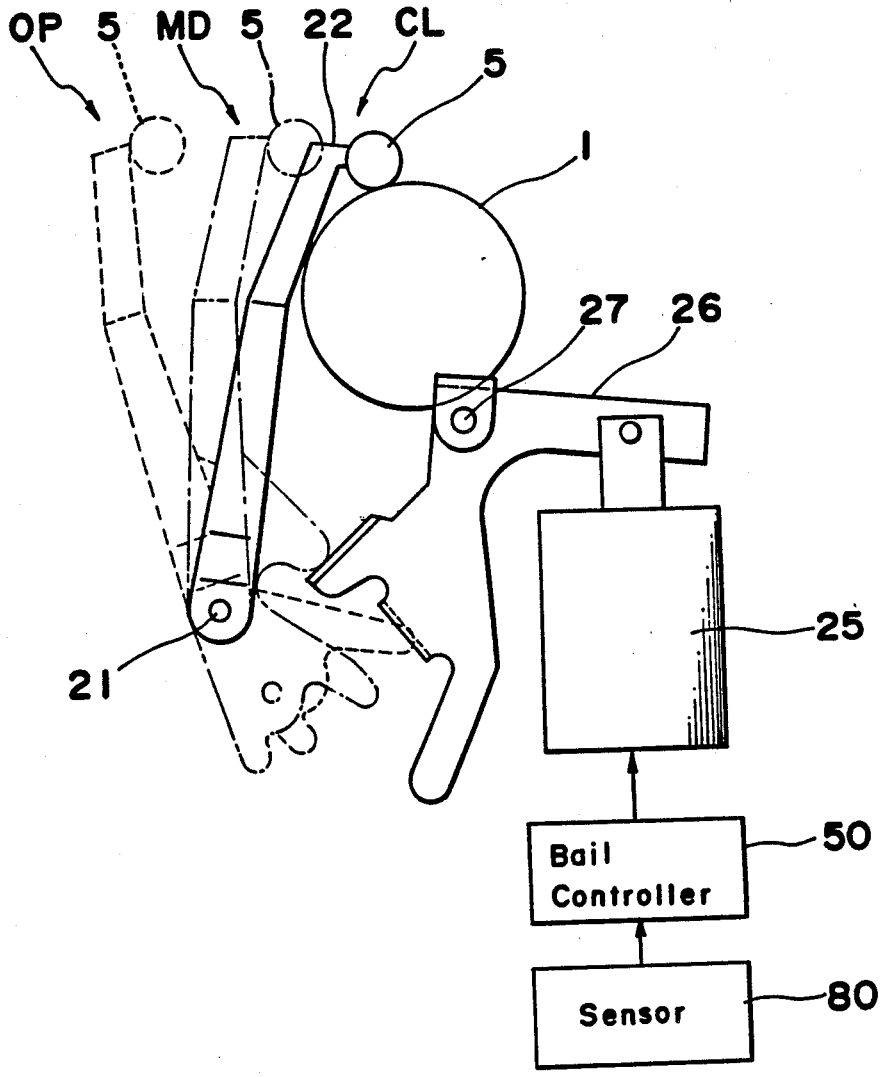
FIG. 5 is a side elevational view for showing positions of the bail roller operated by said operation mechanism.

In a state that the solenoid means 25 is not energized, the bail roller 25 can be operated from said open position OP to said close position CL or vice versa by operating a bail lever provided therefor (not shown). When the bail roller 5 is held at the close position CL, the first projection **22*a* of the arm member 22 is in contact with the first contacting portion 26*a*. On the contrary, when the bail roller 25 is held at the open position, the second projection portion 22*b* of the arm member 22 is in contact with the second contacting portion 26*b*. Referring to FIG. 4, when the solenoid means 25 is energized in a direction indicated by an arrow B in a state wherein the bail roller 5 is held at the close state CL, the lever means 26 is so rotated around the pivot 27 in a clockwise direction as indicated by an arrow A. Due to this rotation, the first projection portion 22*a* is pushed upwardly by the first contacting portion 26*a* of the lever means 26 to swing the arm member 22 around the pivot axis 21 to an intermediate position as indicated by a phantom line MD in FIG. 5. This intermediate position MD is so determined as not to pass over the snap acting point of the snap acting spring 24. This is due to the reason that the bail roller 5 should be automatically returned to the closed position CL thereof by the spring force of the snap acting spring 24** when the power supply to the solenoid means is suspended.

If the bail roller 5 is operated manually toward the open position OP, the spring force of the snap acting 24 is inverted so as to push the arm member 22 toward the open position OP and, therefore, the bail roller 5 is firmly held at the open position OP. In this state, the second projection portion **22*b* of the arm member 22 is located near to the second contacting portion 26*b* of the lever means 26. If the solenoid means 25 is energized in this state, the second contacting portion 26b of the lever means pushes the second projection portion 22b downwardly to move the bail roller 5 to said intermediate position MD passing over the snap acting point of the snap acting spring 24. After that, when the power supply to the solenoid means 25 is stopped, the bail roller 5 is moved to the close position CL by the spring force of the snap acting spring 24**.

According to the operation mechanism mentioned above, the bail roller 5 can be displaced easily by controlling power supply to the solenoid means 25.

According to the present preferred embodiment, the bail roller 5 is automatically held opened as far as the top end portion of a printing sheet is located at the printing position and, when the top end portion has passed over the bail roller 5, it is automatically closed to the first position in order to press the printing paper onto the roller 1.

Figure 6:
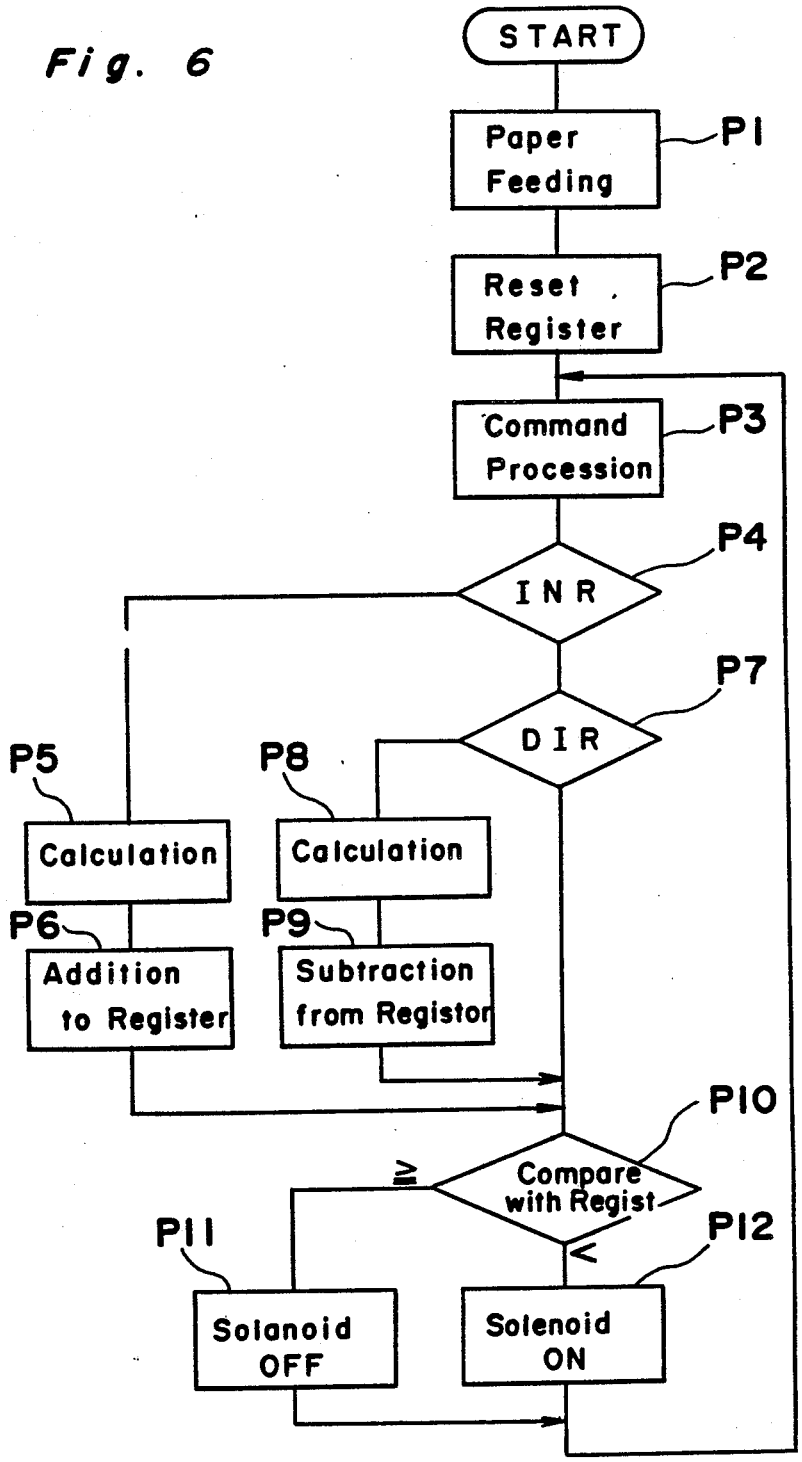
FIG. 6 is a flow-chart of a program for controlling said operation mechanism of the bail roller.

FIG. 6 shows a flow chart of a control program for controlling the operation of the bail roller.

In the present preferred embodiment of the present invention, register means provided in the microcomputer 50 is utilized as a detection means for detecting the top end portion of a printing sheet when it is fed near to the bail roller 5.

Referring now to FIG. 6, when the program is started, a printing sheet is fed to the printing head at step P1 and is wound around the platen roller 1. This sheet feeding operation is carried out, for instance, by operating said semi-auto switch 61 by pulling the bail lever or by pushing said semi-auto switch 61 manually. In the case that an automatic sheet feeding apparatus is equipped to the printer, printing sheets are fed automatically one by one from a feeding tray.

At step P2, said register is reset to "0" at the timing that the top end of a printing sheet is detected to reach to the printing position of the printer by the sensor 80 arranged close to said printing position. Then, at step P3, the printing operation is started according to commands and printing data sent from the host computer 70. At step P4, it is decided whether a command input is for commanding a normal rotation of the platen roller such as a line-feed command. If it is one of commands for a normal rotation, an amount of rotation of the platen roller to be rotated by said command is calculated according to the content of said command at step P5 and a value calculated at step P6 is added to a value memorized in the register and the result is registered thereinto.

If the entered command is decided not to be the command for a normal rotation at step P4, it is decided at step P7 whether the entered command is a command for commanding a reversal rotation of the platen roller. If it is decided to be the command for a reversal rotation, an amount of rotation of the platen roller to be rotated by said command is calculated according to the content of said command (such as a back line feed command) at step P8. The value obtained by said calculation is subtracted from the registered value and the subtracted value is registered into said register at step P9.

Next, at step P10, the registered value is compared with a predetermined reference value corresponding to the distance defined from the printing position to the position of the bail roller 5. If the registered value is smaller than the predetermined value, namely the top end is located between the printing position and the position of the bail roller 5, the solenoid means 25 is energized at step P12 and, therefore, the bail roller 5 is operated to the intermediate position MD.

On the contrary to the above, if the registered value is equal to or larger than the predetermined value, the power supply to the solenoid means 25 is stopped to operate the bail roller 5 to the close position CL at step P11.

If the platen roller 1 is rotated in a reverse direction after the bail roller has been closed once and, thereby the top end is draw back from the bail roller 5, namely it is located again between the printing position and the bail roller, the solenoid means is turned on at step P12 and, therefore, the bail roller 5 is automatically moved to the intermediate position MD.

When the top end of a printing sheet is advanced, according to the progress of printing, to pass over the position of the bail roller again, the bail roller is automatically operated to the close position CL again. Accordingly, any jamming of a printing sheet is prevented.

In the present preferred embodiment, there is employed such a system wherein the register is reset at the timing that the top end of a printing paper is reached to the printing position and, at the same time, the solenoid 25 is energized to cancel the pressing contact of the bail roller 5 onto the platen roller.

However, the present invention is not limited to this preferred embodiment. For example, it is also possible to reset the register to zero at the timing that the feeding operation is started. for example, by pulling the bail lever after setting the top end with respect to the pressure roller 3. In this case, the solenoid can be energized at the same timing as mentioned just above.

Further, although the bail roller is held at the intermediate position MD as far as the top end of a printing sheet is located between the printing position and the position of the bail roller in the present preferred embodiment, the present invention is not limited to this. For intance, such a system can be employed wherein the bail roller 5 is located apart from the platen roller 1 when the top end of a printing paper passes over the position of the bail roller and, thereafter, the bail roller 5 is moved to the close position being contacted onto the plate roller 1.

Figure 7:
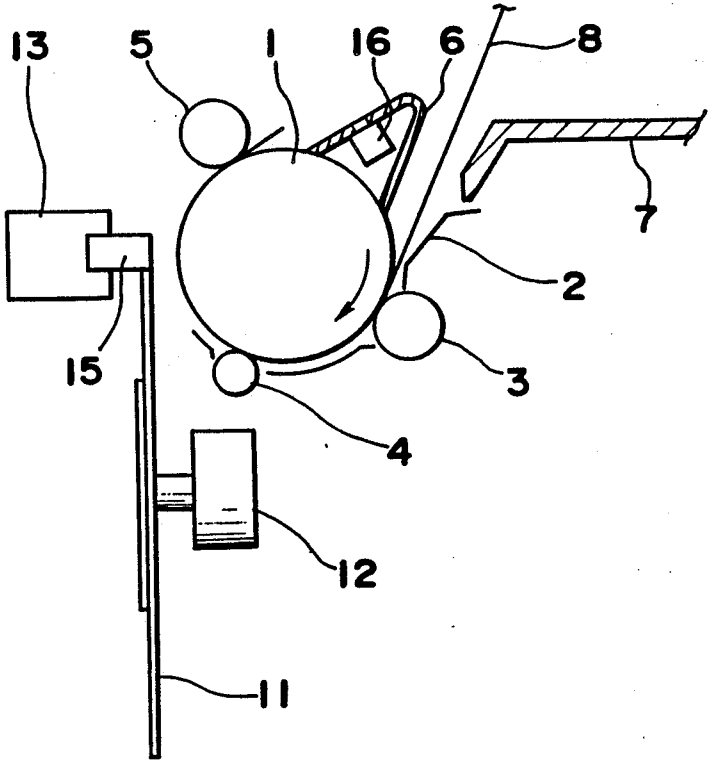
FIG. 7 is a cross-sectional view for showing another preferred embodiment of the present invention.

In FIG. 7, there is shown another preferred embodiment of the present invention.

According thereto, there is provided a photo-sensor 15 which is arranged close to the hammer 13. Further, there is provided one more photo-sensor 16 which is mounted inside of the guide member 6.

In this preferred embodiment, the bail roller 5 is operated to the intermediate position MD when the first photo-sensor 15 detects the top end of a printing paper by energizing the solenoid means 25 and the bail roller 5 is held at the close position, as far as the second photo-sensor 16 is detecting the printing paper, by stopping the power supply to the solenoid means.

If the second photo-sensor 16 is turned off during the process of printing by a reversal rotation of the platen roller, the bail roller 5 is operated to the open position again.

It is also possible to control a printing position of a printing sheet accurately if the first photo-sensor is so arranged on the carriage 52 that it can detect the left-most edge of a printing sheet.

Further, it is also possible to utilize the second photo-sensor as detection means for detecting a jamming of a printing sheet.

What is claimed is:

1. A printer with a printing paper feeding apparatus comprising:

a platen roller rotatable in a normal direction and in a reverse direction;

sheet feeding means for feeding a sheet along a surface of said platen roller in a forward direction and in a backward direction accompanied by the rotation thereof;

printing means for printing images on a printing sheet fed by said sheet feeding means, said printing means being arranged near the platen roller;

pressing means for pressing the sheet on said platen roller and arranged at the leading side with respect to said printing means as viewed in a normal rotational direction of said platen roller, said pressing means being displaceable between a first position at which a portion of the printing sheet is pressed onto said platen roller by said pressing means and a second position at which said pressing means is located apart from said platen roller to permit said sheet to freely pass between said platen roller and said pressing means;

detection means for detecting a position of the sheet being fed along said platen roller by said sheet feeding means; and operation means for moving said pressing means from said first position to said second position or vice versa according to the position of the sheet detected by said detection means, said detection means comprising first detection means for detecting a printing sheet being fed by said sheet feeding means which is arranged at a trailing side of said pressing means with respect to a normal rotational direction of said platen roller and second detection means for detecting a printing sheet being fed by said sheet feeding means which is arranged at a leading side of said pressing means with respect to said normal rotational direction and said operation means moves said pressing means to said second position when said first detection means detects a printing sheet and locates said pressing means at said first position when said second detection means detects a printing sheet and when any printing sheet is not detected by said second detection means.

2. A printer with a printing paper feeding apparatus comprising:

a platen roller rotatable in a normal direction and in a reverse direction;

sheet feeding means for feeding a sheet along a surface of said platen roller in a forward direction and in a backward direction accompanied by the rotation thereof;

printing means for printing images on a printing sheet fed by said sheet feeding means, said printing means being arranged near the platen roller;

pressing means for pressing the sheet on said platen roller and arranged at the downstream side of said printing means in the normal rotational direction of said platen roller, said pressing means being displaceable between a first position at which a portion of the printing sheet is pressed onto said platen roller by said pressing means and a second position at which said pressing means is located apart from said platen roller to permit said sheet to freely pass between said platen roller and said pressing means;

detection means for detecting the location of the sheet being fed along said platen roller by said sheet feeding means relative to said pressing means and said printing means; and operation means for moving said pressing means from said first position to said second position or vice versa according to whether the detection means detects the sheet as being located at a first location relative to said pressing means and said printing means or at a second location relative to said pressing means and said printing means that is different from said first location, wherein said first location includes a top edge of the sheet being located relative to said pressing means and said printing means such that the top edge of the sheet has already passed beyond the printing means in the normal rotational direction and has not reached the pressing means.

3. A printer according to claim 2, wherein said second location includes a top edge of the sheet being located relative to said pressing means and said printing means such that the top edge of the sheet has already passed beyond the printing means in the normal rotational direction and is located at the pressing means.

* * * * *